US005711517A

United States Patent [19]

Kelly

[11] Patent Number: 5,711,517

[45] Date of Patent: Jan. 27, 1998

[54] SHEET MEDIA HANDLING SYSTEM

[75] Inventor: Kieran B. Kelly, Vancouver, Wash.

[73] Assignee: Hewlett-Packard Company, Palo Alto, Calif.

[21] Appl. No.: 612,142

[22] Filed: Mar. 7, 1996

[51] Int. Cl.[6] ..... B65H 5/22

[52] U.S. Cl. ..... 271/4.01; 271/9.11; 271/162; 271/171; 271/207; 312/333

[58] Field of Search ..... 271/3.14, 4.01, 271/145, 9.11, 162, 164, 171, 207, 213; 312/333

[56] References Cited

U.S. PATENT DOCUMENTS

| | | | |
|---|---|---|---|
| 4,794,859 | 1/1989 | Huseby et al. . | |
| 4,915,370 | 4/1990 | Himeji et al. | 271/145 |
| 5,052,670 | 10/1991 | Makiura et al. | 271/164 |
| 5,261,651 | 11/1993 | Ishida . | |
| 5,324,020 | 6/1994 | Rasmussen et al. . | |
| 5,354,044 | 10/1994 | Firl et al. | 271/4.01 |
| 5,384,624 | 1/1995 | Kajiwara | 271/3.14 |
| 5,511,770 | 4/1996 | Okazaki | 271/3.14 |

FOREIGN PATENT DOCUMENTS

| | | | |
|---|---|---|---|
| 0 699 536 A2 | 3/1996 | European Pat. Off. . | |
| 0003824 | 1/1991 | Japan | 271/162 |
| 4085220 | 3/1992 | Japan | 271/162 |
| 1 419 508 | 12/1975 | United Kingdom . | |
| 2 268 708 A | 1/1994 | United Kingdom . | |

*Primary Examiner*—H. Grant Skaggs

[57] ABSTRACT

A sheet media handling system is provided for use in a sheet processor having support structure which is configured to accommodate reliable sheet pick-up and to minimize the sheet processor's size, while still offering suitable access to the media sheets. The handling system includes upper and lower support structure, the lower support structure supporting sheets for delivery to an input port, and the upper support structure supporting sheets which are expelled from an output port. The lower support structure includes a drawer configured for translation between a fully-dosed drawer position and a fully-open drawer position. Correspondingly, the upper support structure includes a door configured to pivot between a fully-closed door position and a fully-open door position. An overcenter mechanism is employed to bias the drawer either into a fully-closed drawer position or toward a fully-open drawer orientation.

13 Claims, 4 Drawing Sheets

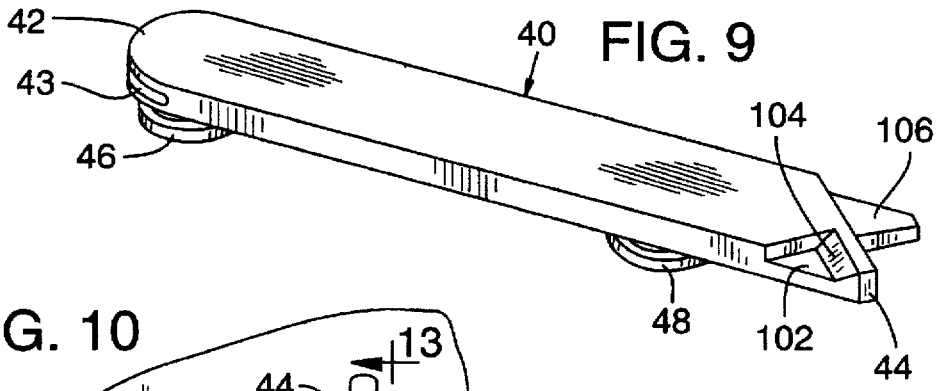
FIG. 9
FIG. 10
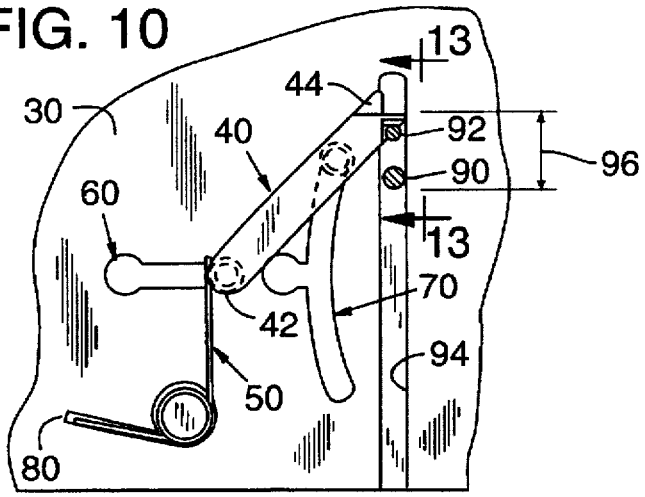
FIG. 11
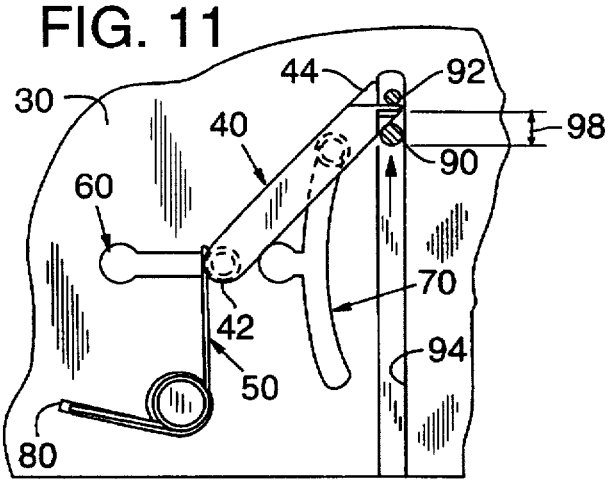
FIG. 12
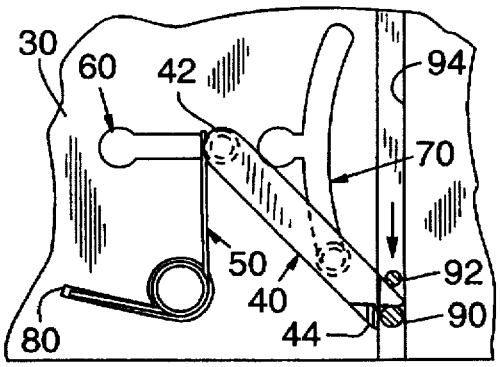
FIG. 13
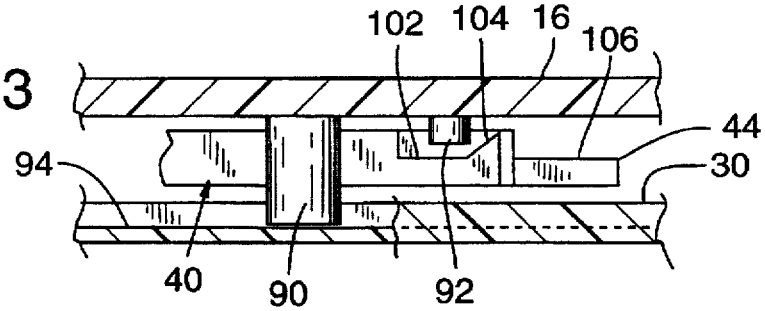

SHEET MEDIA HANDLING SYSTEM

TECHNICAL FIELD

The present invention relates generally to the handling of sheet media in a sheet processor, and more particularly, to a media handling system which employs a tray arrangement configured to pro, de versatile sheet media storage and reliable sheet media flow. Although the invention has utility in a variety of sheet processing machines, it has proven particularly well suited for use in a single-sheet printer, and is described in that context below.

BACKGROUND ART

In a conventional single-sheet printer, media is directed through a print cycle which includes picking up a sheet from an input tray, feeding it through the printer, and then expelling it through the printer's output port to an output tray. The input and output trays collectively define a tray arrangement, such arrangement typically including a plurality of horizontal tray structures which have been stacked vertically in an attempt to minimize the printer's footprint, and thereby, to conserve space. In fact, the input tray may reside partially within the printer, often beneath the printer's printing mechanism so as to improve media pick-up and further reduce the printer's size.

Unfortunately, the use of stacked tray arrangements has led to difficulties in gaining access to the trays, especially where the tray is recessed into the printer as described above. This difficulty is most apparent where smaller forms of media are used, thereby requiring the operator to reach deeply into the printer when loading or unloading media from the tray. Such a task, however, may be counter-intuitive to the operator, and may be physically difficult to achieve. It thus would be desirable to provide a tray arrangement configured to accommodate improved operator access to both the input and output trays.

Some printers have been designed with a removable tray structure, thereby allowing the operator to gain full access to the trays. This arrangement, however, typically requires the operator to completely remove a tray, and to set it aside on a flat work surface where the media may be loaded or unloaded. The operator thus is required to at left partially disassemble the printer, a task which he or she may be hesitant to perform. The operator also must have access to a flat work surface on which he or she may set the tray once it has been removed. Further, removable trays typically are somewhat loose, and may fall out when the printer is moved.

As an alternative, some printer designers have employed retractable drawers, often in the form of telescoping trays configured to translate media from entirely within to entirely outside the printer. An operator thus is able to gain full access to the media simply by opening the appropriate tray or drawer. Unfortunately, such tray arrangements are expensive, and may be bulky due to the strength and durability necessary to fully translate a media stack. Further, although the printer's footprint may be relatively small when the drawer is fully retracted, it typically is necessary to allocate additional space for the printer so as to provide for opening and closing of the drawer. This, in turn, may negate any space savings achieved from of stacking the input and output trays.

Further, printers with removable or retractable trays may encounter difficulties related to the proper seating of such trays, generally due to the tolerances required in order to provide for reliable pick-up of media sheets. It will be appreciated, for example, that even a small variance in the position of an input tray may result in failure of a conventional printer's pick mechanism, which typically operates by frictional engagement between a pick roller and a media sheet. One such pick mechanism is shown in U.S. Pat. No. 5,269,506 which names Olsen et al. as inventors, and which is commonly owned herewith. The disclosure of that patent is incorporated herein by this reference.

One approach to solving the problems which arise from improper seating of a tray has been to give the printer aesthetic characteristics which visually signal accurate positioning of the tray. This has proven effective as a way of notifying the operator of when a tray is grossly out of position, but has heretofore been less than effective at signaling slight misalignments, which nevertheless may interfere with proper sheet movement. Another approach has involved the use of detents which engage the tray upon seating thereof to give the operator an audible or tactile signal. Again, this has been less than effective as a way of signaling slight misalignment of a tray. It will be appreciated, for example, that the typical operator may not notice such signal, or may not interpret the signal as a cue to reposition the tray. What is needed is a sheet media handling system which provides the operator with improved media access, but which also ensures proper seating of the trays.

DISCLOSURE OF THE INVENTION

The invented system addresses these problems by provision of a sheet media handling system for use in a sheet processor having support structure which is configured to accommodate reliable sheet pick-up and to minimize the sheet processor's size while still providing suitable access to the media sheets. The sheet processor thus is provided with upper and lower support structure, the lower support structure supporting sheets for delivery to an input port, and the upper support structure supporting sheets which are expelled from an output port. The lower support structure includes a drawer configured for translation between a fully-closed drawer position and a fully-open drawer position. Correspondingly, the upper support structure includes a door configured to pivot between a fully-closed door position and a fully-open door position.

The handling system also is provided with an overcenter mechanism, such mechanism including first and second guide paths, and a lever with first and second guide pins which travel along corresponding guide paths. The first guide path extends transverse to a path of drawer translation. The second guide path extends along the path of drawer translation. A spring biases the lever to urge the first guide pin along the first guide path toward the second guide path, and to urge the second guide pin either in an opening or closing direction along the second guide path. The second guide pin is urged in the closing direction when its on one side of the first guide path and is urged in an opening direction when its on the opposite side of the first guide path. Correspondingly, the lever is configured to engage a primary tab of the drawer to urge the drawer toward the fully-closed drawer position when the second guide pin moves in the closing direction and to urge the drawer toward a fully-open position when the second guide pin moves in the opening direction.

In the preferred embodiment, the drawer further includes a secondary tab, the lever and secondary tab being configured to permit passage of the secondary tab by the lever upon translation of the drawer in a closing direction, but to provide for capture of the lever by the secondary tab upon translation of the drawer in an opening direction. The lever thus typically will include a ramp region having a sloped leading edge and a generally vertical trailing edge. Correspondingly, the secondary tab typically will be sized to deflect the lever or drawer upon engaging the leading edge and to capture the lever upon engaging the trailing edge.

These and additional objects and advantages of the present invention will be more readily understood after a consideration of the drawings and the detailed description which follows.

BRIEF DESCRIPTION OF THE DRAWINGS

FIG. 9 is an enlarged isometric view of a guide lever which forms a part of the overcenter mechanism depicted in FIG. 4.

FIGS. 10–12 are enlarged fragmentary plan views which illustrate a self-correcting feature of the overcenter mechanism depicted in FIG. 4.

FIG. 13 is a side sectional view taken generally along line 13—13 of FIG. 10.

DETAILED DESCRIPTION OF THE PREFERRED EMBODIMENT AND BEST MODE OF CARRYING OUT THE INVENTION

Figure 1:
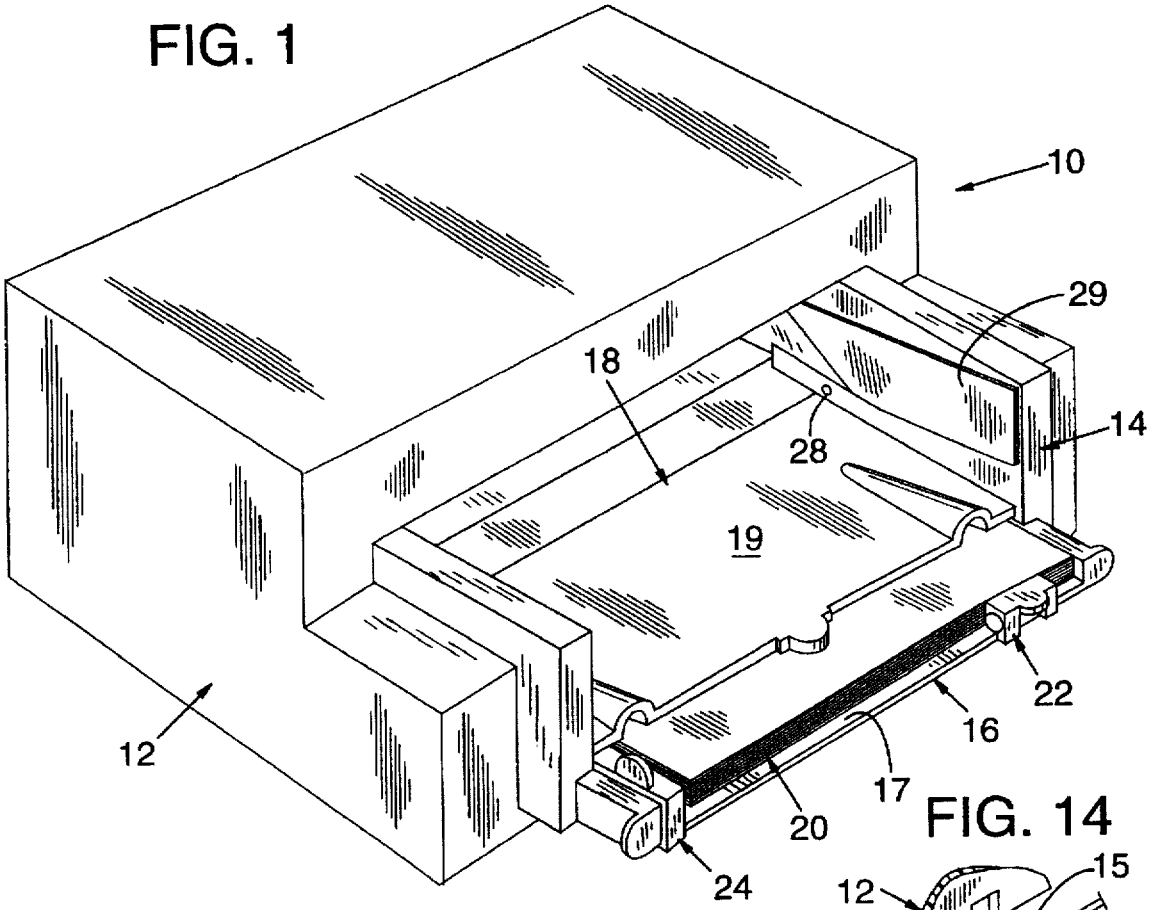
FIG. 1 is an isometric view of a single-sheet printer, such printer incorporating an input/output sheet cassette with a sheet media handling system constructed in accordance with the present invention.

FIG. 1 shows, at 10, a sheet processor in the form of a somewhat typical single-sheet printer, such printer including a chassis 12 and an input/output sheet cassette 14. The cassette includes upper and lower sheet media support structures, the lower structure 16 being configured to support sheets prior to input, and the upper structure 18 being configured to support sheets which have been expelled. The lower support structure thus serves as an input tray, and the upper support structure serves as an output tray. The sheet path similarly is somewhat conventional, sheets being picked up from the input tray, printed on and expelled to the output tray.

Input tray 16 supports sheets (i.e., input media stack 20) for delivery to the printer's print mechanism (not shown), the input tray defining a generally planar, generally horizontal input tray floor 17 which spans the distance between opposite side walls of the input/output sheet cassette. Correspondingly, output tray 18 supports sheets which have been expelled after printing, the cassette's output tray defining a generally planar, nominally horizontal output tray floor including a pivotal door 19 which similarly extends between opposite side walls of the input/output sheet cassette as will be described further below. Cassette 14 thus will be understood to serve as a sheet media handling system which employs a vertically-stacked tray arrangement whereby sheets are held both prior to input and once they have been expelled.

Alignment of the input sheet stack is maintained via an alignment mechanism which includes a length adjuster 22 and a width adjuster 24, each of which engages an edge of the stack. The length adjuster engages a front edge of the stack so as to maintain lengthwise alignment by urging the stack against the input tray's rear wall. The width adjuster engages a side edge of the stack so as to maintain widthwise alignment by urging the stack against the input tray's right side wall. Each is movable along an onboard track (length adjuster track 23 and width adjuster track 25 in FIG. 3) so as to provide the input tray with adaptability to accommodate different-size media sheets. Both are configured so that they will not interfere with the output tray door when the cassette is in a fully-closed orientation (FIG. 1).

Figure 14:
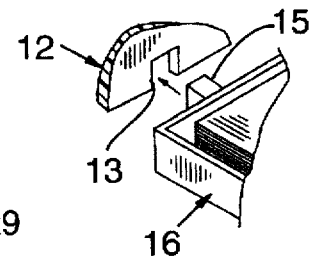
FIG. 14 is a fragmentary exploded isometric view depicting a datum arrangement whereby a printer's input tray may be aligned with its chassis.

As should be apparent, input tray 16 takes the form of an elongate drawer which is configured to translate between open and closed positions as indicated by arrow 26. The input tray typically travels along the cassette's floor 30 (FIG. 4), such floor being provided with a track 32 which guides the tray linearly into and out of the printer chassis. A datum arrangement (indicated generally by opening 13 and peg 15 in FIG. 14) ensures that the drawer is properly seated when the drawer is closed. More specifically, the datum arrangement defines orthogonal guides for the drawer. Peg 15 thus includes an upper surface which engages a corresponding ceiling of opening 13 (the drawer itself engages cassette floor 30 as an opposite guide), and opposite side surfaces which engage corresponding side walls of opening 13. Facing surfaces of the drawer and chassis engage to define a fully-closed drawer position. A drawer stop 27 is employed to limit passage of the input tray, such stop typically being configured to prevent the operator from inadvertently opening the input tray to beyond a predetermined fully-open position (shown in FIGS. 2 and 3). The drawer stop, however, may be made resilient to accommodate release of the input tray so that it may be removed for service.

Figure 2:
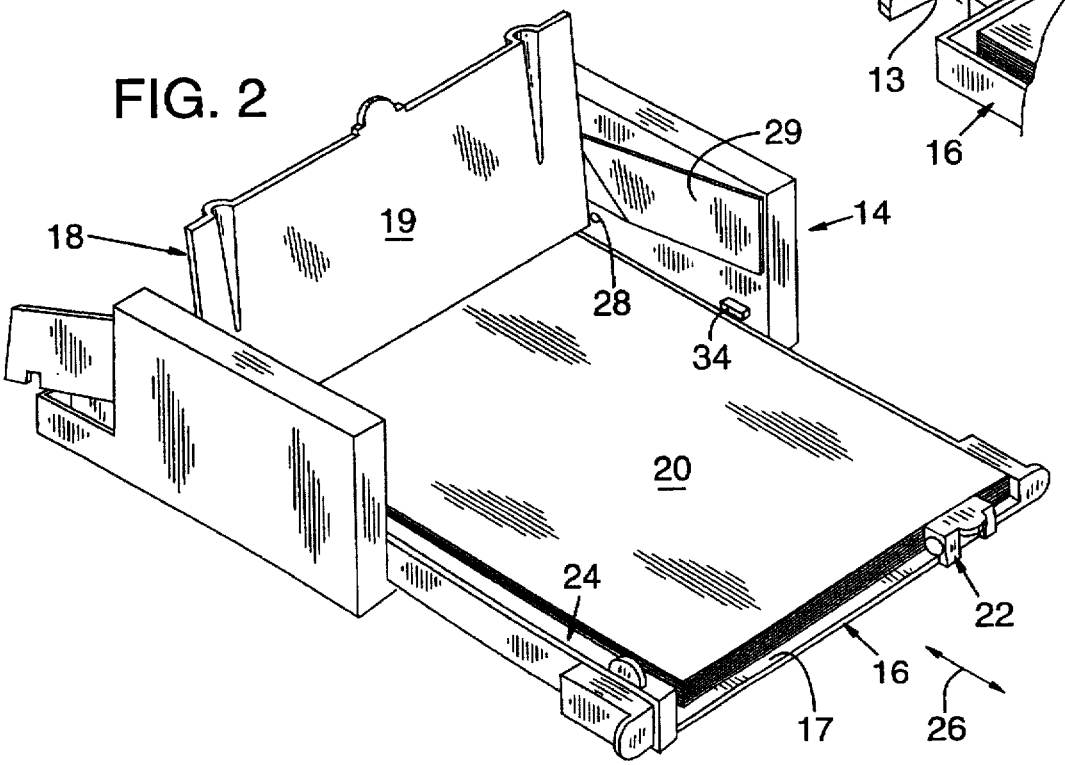
FIG. 2 is an isometric view of the input/output sheet cassette depicted in FIG. 1, such view showing a pivotally opened output tray door and a slidably opened input tray drawer to illustrate the manner in which an operator gains access to an input media stack.
Figure 3:
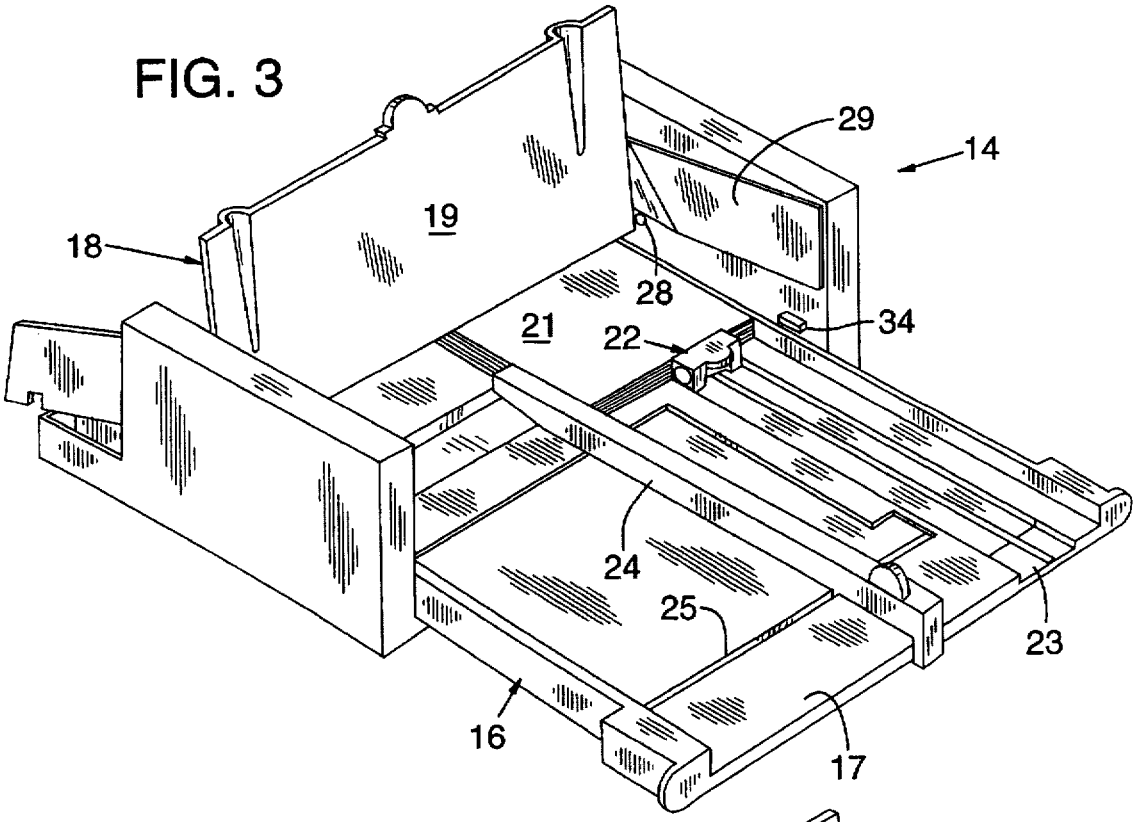
FIG. 3 is an isometric view similar to that of FIG. 2, but showing smaller sheet media to illustrate adaptability of the system.
Figure 4:
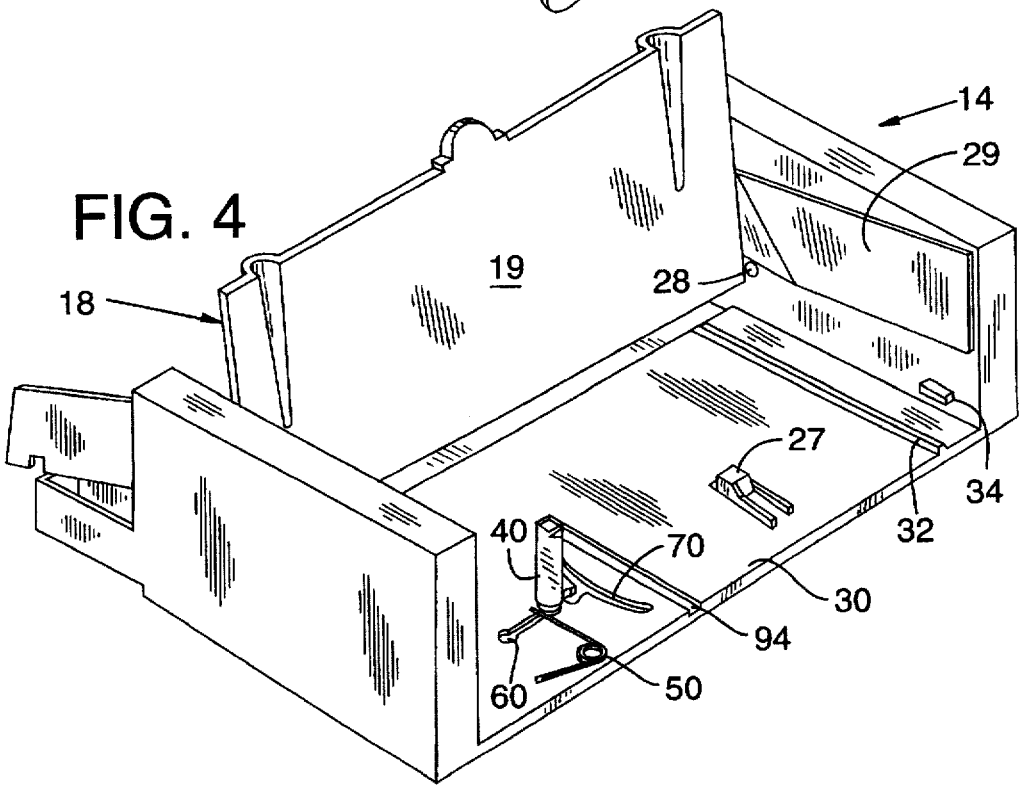
FIG. 4 is an isometric view of the input/output sheet cassette of FIG. 2, but with the output tray door and input tray drawer removed so as to expose an overcenter mechanism for use in connection with the input tray drawer.

Output tray 18 includes a pivotal door 19 which is hinged at or near its lower edge so as to accommodate pivotal opening and closing thereof. FIG. 1 shows the output tray door in its closed position. FIGS. 2 through 4 show the output tray door in its open position. As indicated, the output tray is held in its open position by detents such as that shown at 28, the detents typically being formed on the interior of the cassette's side walls so as to provide an obstruction to forward pivot of the opened door. Reverse pivot is limited by engagement with printer chassis 12.

In the preferred embodiment, the detents are sized so as to oppose passage of the output tray door until application of a predetermined force, with passage of the door over the detent giving both auditory and tactile feedback so as to reinforce the operator's visual cues. The cassette's drying wings 29 pivotally retract, such wings being positioned so as to complement operation of the door. Upon closing the door, the wings return to their sheet-supporting orientation, the door typically being pivoted to a generally horizontal position where it rests against limiting tabs such as that shown at 34.

It is to be understood that the input and output trays are independently configurable, making for a cassette which is capable of providing varying degrees of access to the input tray. For example, the cassette may be configured in: 1) a fully-closed orientation (where both the input tray drawer and the output tray door are closed); 2) a drawer-open orientation (where only the input tray drawer is open); 3) a door-open orientation (where only the output tray door is open); or 4) a fully-open orientation (where both the input tray drawer and the output tray door are open). Therefore, it is possible to load or unload large media (US-A media or A4 media) either by opening the input tray drawer, or by opening the output tray door. Small media (i.e., card-size media), in contrast, may require the operator to open both the input tray drawer and the output tray door.

In FIG. 2, cassette 14 is shown in a fully-open orientation, the input and output trays both being configured to enhance access to the input tray. Input tray 16, for example, is shown in a fully-extended (or fully-open) position, the tray having been "pulled out" a distance equal to approximately one-half its length so as to expose a corresponding portion of thereof. Similarly, output tray 18 is shown with door 19 pivoted to its fully-open position, thereby exposing the remainder of the input tray. This configuration exposes virtually the entirety of a large media stack such as that shown at 20 in FIGS. 1 and 2), and similarly would expose virtually the entirety of a smaller media stack (such as that shown at 21 in FIG. 3) so that such media may be readily loaded and unloaded regardless of its size.

Focussing now on FIG. 4 (which shows cassette 14 with input tray 16 removed), it will be noted that the depicted cassette has been fitted with an overcenter mechanism which may be used to ensure that the input tray is either fully closed, or open an appreciable amount. The overcenter mechanism includes a lever 40 which is biased by a spring 50 to track along a pair of associated guide slots 60, 70 in the cassette's floor. The spring also typically is mounted in a floor slot 80. Under bias of spring 50, the lever engages a tab which is mounted on the undersurface of the input tray drawer, thereby urging the drawer either into a fully-closed position (FIG. 1), or toward an intermediate open position where the drawer is sufficiently open to visually cue the operator that the drawer must be closed. The drawer's status (open or closed) is important to a printer's operator because the printer may experience difficulties in picking up media and/or accurately passing media to the printer mechanism when the drawer is not fully-closed.

Figure 5:
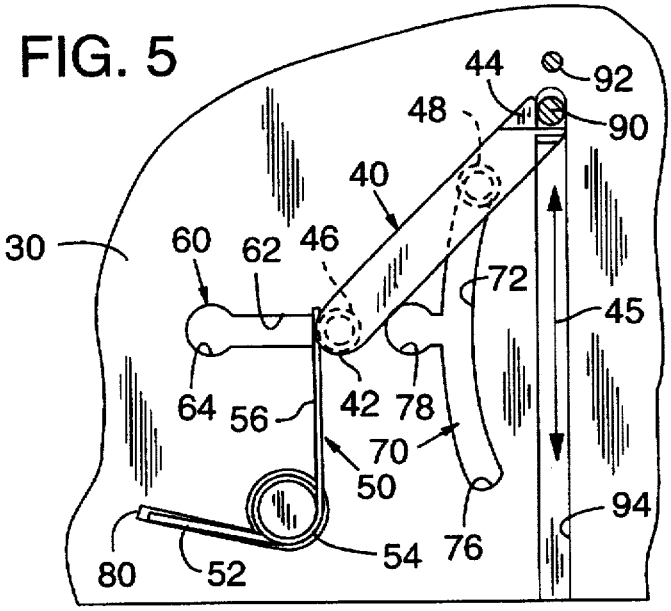
FIGS. 5–7 are enlarged fragmentary plan views depicting the operation of the overcenter mechanism of FIG. 4, such mechanism being shown in respectively in drawer-closed, metastable and drawer-open orientations.
Figure 6:
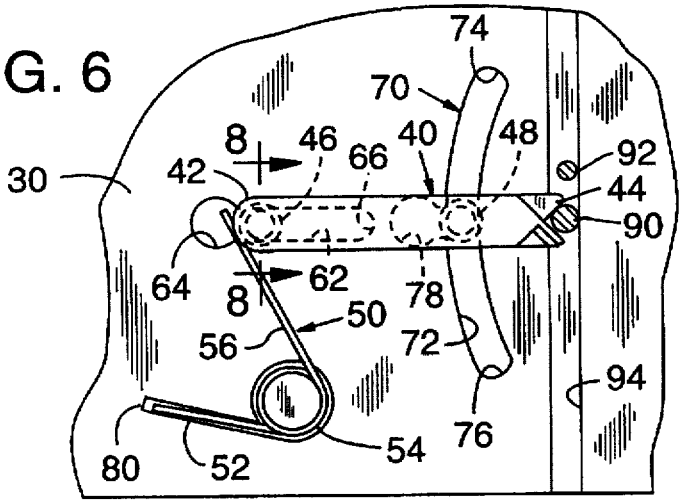
Figure 7:
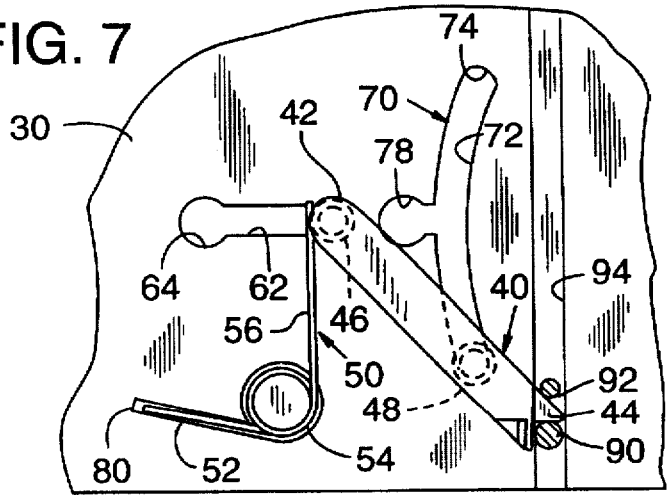

Operation of the overcenter mechanism initially is demonstrated in FIGS. 5–7 which show such mechanism in a fully-closed orientation, a metastable orientation, and a fully-open orientation, respectively. The fully-closed orientation of the overcenter mechanism corresponds to the fully-closed position of the input tray drawer (FIG. 1). The fully-open orientation of the overcenter mechanism, however, need not correspond to the drawer's fully-open position. Rather, the overcenter mechanism's fully-open orientation may correspond to an intermediate open position of the drawer as set forth above. The overcenter mechanism's metastable orientation corresponds to a metastable drawer position which is at the crossover between orientations where the overcenter mechanism will urge the drawer into the fully-closed position and orientations where the overcenter mechanism will urge the drawer toward an intermediate open position.

Figure 8:
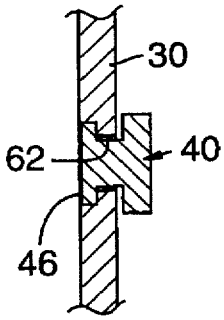
FIG. 8 is a further-enlarged fragmentary, side-sectional view taken generally along lines 8—8 of FIG. 6.

As indicated, lever 40 is an elongate member having a first end 42 which is engaged by the bias spring, and a second end 44 which engages a primary tab 90 of the drawer. First end 42 defines a slit 43 (FIG. 9) for capture of spring 50. Second end 44 is specially-configured to capture primary tab 90, the second end defining a generally V-shaped notch as will be described in detail below. Additionally, the lever is provided with a pair of downwardly-projecting guide pins 46, 48, each being configured to fit within a corresponding guide slot 60, 70, respectively. A first pin 46 is at or near the lever's first end 42. A second pin 48 is more centrally positioned, but typically toward the lever's second end. Each pin is configured to track within its corresponding guide slot, and may be configured for capture within the slot as indicated generally in FIG. 8.

Spring 50 typically takes the form of a torsion spring having a first leg 52 captured within floor slot 80, a coil portion 54, and a second leg 56 which engages slit 43 of lever 40. The spring thus tends to urge the lever's first end along slot 60 (via pin 46), and the lever's second end along a path indicated by arrow 45 (via pin 48).

Each guide slot defines a path for a corresponding guide pin, such paths being selected to provide for proper operation of the drawer. Slot 60, for example, takes the form of an elongate, generally straight path 62 which extends generally perpendicular to the path of drawer travel (indicated at 45 in FIG. 5) between opposite slot ends 64, 66. Slot 70 takes the form of an arcuate path 72 which extends along the path of drawer travel between opposite ends 74, 76. The length of path 62 corresponds to the path of first pin 46, as caused by travel of second guide pin 48 along the span of path 72.

The center (or apex) of arcuate path 72 is in alignment with path 62, providing the overcenter mechanism with a metastable orientation wherein pin 48 positioned as shown in FIG. 6. Correspondingly, when pin 48 is on one side of the arcuate path's apex (above the apex in FIGS. 5–7), the lever will be biased toward its fully-dosed orientation (FIG. 5), and when pin 48 is on the other side of the arcuate path's apex (below the apex in FIGS. 5–7), the lever will be biased toward its fully-open orientation (FIG. 7). Accordingly, the input tray drawer typically will be biased either into a fully-closed position, or toward an open orientation which is readily identifiable by the operator.

The guide slots preferably are configured to accommodate selected release of lever 40. Slot 60 thus defines a first enlarged opening at or near end 64. Slot 70 defines a release path 78 which projects from the apex of arcuate path 72 to define a second enlarged opening. The lever is removed by urging it (against the force of spring 50) into a position where pins 46 and 48 may pass through the first and second enlarged openings respectively.

Another feature of the overcenter mechanism is demonstrated in FIGS. 10 through 13, the depicted mechanism being configured to self-correct in the event of misalignment between lever 40 and the input tray drawer. This most typically will occur where lever 40 is already in a fully-closed position when the input tray drawer is yet-to-be dosed. Accordingly, when the operator does attempt to close the drawer, primary tab 90 will engage a forward edge of lever 40 prior to the drawer reaching its fully-closed position (see, e.g., FIG. 11). This, in turn, will keep the drawer from full closing, and may correspondingly interfere with sheet pick-up.

To address this problem, the depicted input tray drawer has been provided with both a primary tab 90 and a secondary tab 92, the secondary tab being configured to accommodate realignment of lever 40 simply by closing and then re-opening the input tray drawer. The primary and secondary tabs travel along the same path during opening and closing of the drawer, the primary tab typically reaching into a channel 94 which extends along the cassette floor.

As indicated in FIG. 13, secondary tab 92 is shorter than the primary tab 90, the secondary tab thus being capable of passing over the lever upon predetermined deflection of the lever or drawer. The primary tab is not able to pass over the lever. Lever 40 correspondingly is given a contour which facilitates such passage, but which also ensures that primary tab 90 will not similarly be passed. Such contour is best illustrated in FIG. 9, wherein the lever's second end will be seen to define a first pass region 102, a ramp region 104, and a second pass region 106.

The first and second pass regions each have an elevation which allows passage of the secondary tab, but prevents passage of the primary tab. The ramp region has a leading edge which slopes from the first pass region to accommodate deflection of the lever or drawer upon engagement by the secondary tab and passage of the secondary tab over the ramp region when the drawer is translated in a first direction (a drawer-closing direction). The ramp region has a trailing edge which is generally perpendicular to the second pass region so as to oppose passage of the secondary tab over the ramp region when the drawer is translated in a second direction (a drawer-opening direction).

Therefore, referring to FIGS. 10 through 12, it will be understood that the overcenter mechanism will self-correct by simply closing and then reopening the input tray drawer (the drawer is represented by primary pin 90 and secondary pin 92). Accordingly, when lever 40 is misaligned, the input tray drawer may be translated (closed) without significant resistance to the position shown in FIG. 10, at which point secondary tab 92 will engage the leading edge of the lever's ramp region. This occurs when the drawer is a first distance 96 from its fully-closed position. Further translation (closing) of the input tray drawer will result in deflection of the lever or drawer, the secondary tab thus being allowed to pass over the ramp region as indicated in FIG. 11. However, the drawer will be stopped short of its fully-closed position due to engagement between primary tab 90 and second end 44 of lever 40. This drawer thus will close only to a position which is a second distance 98 from its fully-closed position, a shortfall which is likely to detract from performance of the printer's sheet media pick-up mechanism. When the drawer is opened, secondary tab 92 will engage the trailing edge of the ramp region, pulling the lever against the bias of spring 50 to just beyond its metastable position. Thereafter, spring 50 will urge the lever to the fully-open orientation shown in FIG. 12.

INDUSTRIAL APPLICABILITY

The invented sheet media handling system is useable in virtually any sheet processor wherein sheets are to be input from an input tray, but is especially well suited for use in a sheet processor which employs vertically stacked input and output trays. The system decreases the sheet processor's effective footprint, while increasing accessibility to the input tray and improving reliability of sheet media pick-up.

While the present invention has been shown and described with reference to the foregoing operational principals and preferred embodiment, it will be apparent to those skilled in the art that various changes in form and detail may be made without departing from the spirit and scope of the invention as defined by the claims.

I claim:

1. A sheet media handling system for use in a sheet processor having a chassis with vertically-stacked input and output ports, said handling system comprising:

a lower support structure configured to support sheets for delivery to the input port, said lower support structure including an elongate drawer configured for translation between a fully-closed drawer position and a fully-open drawer position said drawer including a primary tab; and an upper support structure configured to support sheets expelled from the output port, said upper support structure overlying said lower support structure and including a door configured to between a fully-closed door position and a fully-open door position, whereby sheets within said of said lower support structure are substantially fully exposed when said drawer is in said drawer position and said door is in said fully-open door position;

an overcenter mechanism operatively mounted on the chassis said overcenter mechanism including a lever with first and second guide pins, each configured to traverse corresponding first and second guide paths, said first guide path extending transverse to a path of drawer translation and said second guide path extending generally along a path of drawer of drawer translation said overcenter mechanism further including a spring configure to engage said lever to urge said first guide pin along said first guide path toward said second guide path, said second guide pin thus being urged in a closing direction along said second guide path when said second guide pin is on one side of said first guide path and in an opening direction along said second guide path when said second guide pin is on an opposite side of said first guide path, said lever being configured to urge said drawer toward said fully-closed drawer position when said second guide pin moves in said direction and to urge said drawer toward a fully-open position when said second guide pin moves in said opening direction;

said lower support structure thus being configured for access by translation of said drawer, by pivot said door, or by a combination of drawer translation and door pivot.

2. The handling system of claim 1, wherein said drawer is configured to translate lengthwise between said fully-closed drawer position and said fully-open drawer position, said fully-open drawer position corresponding to a position wherein said drawer has been displaced from said fully-closed drawer position a distance approximately equal to ½ drawer length.

3. The handling system of claim 1, wherein said door is configured to reveal approximately ½ of said drawer upon pivot of said door from said fully-closed door position and said fully-open door position with said drawer in said fully-closed drawer position.

4. A sheet media handling system for use in a sheet processor having a chassis and an input port, said handling system comprising:

a support structure including a drawer configured for translation between a fully-closed drawer position wherein said drawer delivers media to said input port and a fully-open drawer position wherein said drawer is to be loaded with media; and an overcenter mechanism operatively mounted on the chassis and including a spring-biased lever configured to engage said drawer to bias said drawer toward said fully-closed drawer position whenever said drawer is between a metastable drawer position and said fully-closed drawer position, and to bias said drawer toward said fully-open drawer position whenever said drawer is between said metastable drawer position and an intermediate open drawer position, said overcenter mechanism defining first and second guide paths and said lever including first and second guide pins configured to traverse said guide paths, said metastable drawer position being between said fully-open drawer position and said fully-closed drawer position.

5. The handling system of claim 4 which-further comprises a datum arrangement associated with the drawer and chassis, whereby said drawer is directed to said fully-closed drawer position.

6. The handling system of claim 4, wherein said drawer includes a primary tab, said spring-biased lever being configured to engage said primary tab when said drawer is between said fully-closed position and said intermediate-open position.

7. The handling system of claim 6, wherein said drawer further includes a secondary tab, said lever and secondary tab being configured to permit passage of said secondary tab by said lever upon translation of said drawer in a closing direction, but to provide for capture of said lever by said secondary tab upon translation of said drawer in an opening direction.

8. The handling system of claim 7 wherein said lever includes a ramp region having a sloped leading edge and a generally vertical trailing edge, said secondary tab being sized to effect relative deflection of said lever and said drawer upon engaging said leading edge and to capture said lever upon engaging said trailing edge.

9. The handling system of claim 4, wherein said second guide path defines an are which extends along a path of drawer translation and said first guide path defines a line which extends transversely to said path of drawer translation, exterior to said are, and in alignment with an apex of said arc.

10. The handling system of claim 9, wherein said overcenter mechanism further includes a spring which engages said lever to urge said first guide pin along said first guide path toward said apex of said second path arc, said second guide pin being urged in a closing direction along said second guide path when said second guide pin is on one side of said apex and in an opening direction along said second guide path when said second guide pin is on an opposite side of said apex.

11. A sheet media handling system for use in a sheet processor having a chassis with vertically-stacked input and output ports, said handling system comprising:

a lower support structure configured to support sheets for delivery to the input port, said lower support structure including an elongate drawer configured for lengthwise translation between a fully-closed drawer position and a fully-open drawer position, said drawer including a primary tab;

an upper support structure configured to support sheets expelled from the output port, said upper support structure including a door configured to pivot between a fully-closed door position and a fully-open door position; and an overcenter mechanism including first and second guide paths wherein said first guide path extends transverse to a path of drawer translation and said second guide path extends generally along a path of drawer translation, a lever with first and second guide pins configured to traverse corresponding first and second guide paths, and a spring configured to engage said lever to urge said first guide pin along said first guide path toward said second guide path, said second guide pin thus being urged in a closing direction along said second guide path when said second guide pin is on one side of said first guide path and in an opening direction along said second guide path when said second guide pin is on an opposite side of said first guide path, said lever being configured to urge said drawer toward said fully-closed drawer position when said second guide pin moves in said closing direction and to urge said drawer toward a fully-open position when said second guide pin moves in said opening direction.

12. The handling system of claim 11, wherein said drawer further includes a secondary tab, said lever and said secondary tab being configured to permit passage of said secondary tab by said lever upon translation of said drawer in a closing direction, but to provide for capture of said lever by said secondary tab upon translation of said drawer in an opening direction.

13. The handling system of claim 12, wherein said lever includes a ramp region having a sloped leading edge and a generally vertical trailing edge, said secondary tab being sized to effect relative deflection of said lever and said drawer upon engaging said leading edge and to capture said lever upon engaging said trailing edge.

* * * * *

UNITED STATES PATENT AND TRADEMARK OFFICE

CERTIFICATE OF CORRECTION

PATENT NO. : 5,711,517
DATED : January 27, 1998
INVENTOR(S) : Kelly

It is certified that error appears in the above-indentified patent and that said Letters Patent is hereby corrected as shown below: In the Abstract Line 10, delete "fully-dosed" and insert therefor --fully-closed--.

Column 1 (line 7), delete "pro, de" and insert therefor --provide--.

Column 1 (line 43), delete "left" and insert therefor --least--.

Column 6 (line 35), delete "fully-dosed" insert therefor --fully-closed--.

Column 6 (line 56), delete "dosed" and insert therefor --closed--.

Column 7 (line 7), delete "," and insert therefor --.--

Column 8 (line 10), after "to", insert --pivot--.

Column 8 (line 12), after "within said", insert --drawer--.

Column 8 (line 13), after "in said", insert --fully-open--.

UNITED STATES PATENT AND TRADEMARK OFFICE

CERTIFICATE OF CORRECTION

PATENT NO. : 5,711,517

DATED : January 27, 1998

INVENTOR(S) : Kelly

It is certified that error appears in the above-indentified patent and that said Letters Patent is hereby corrected as shown below:

Column 8 (line 17), after "chassis", insert --,--.

Column 8 (line 22), after "path", delete "of drawer" (first occurrence).

Column 8 (line 23), after "lation", insert --,--.

Column 8 (line 24), delete "configure" and insert therefor --configured--.

Column 8 (line 33), after "in said", insert --closing--.

Column 8 (line 38), after "pivot", insert --of--.

UNITED STATES PATENT AND TRADEMARK OFFICE

CERTIFICATE OF CORRECTION

PATENT NO. : 5,711,517

DATED : January 27, 1998

INVENTOR(S) : Kelly

It is certified that error appears in the above-indentified patent and that said Letters Patent is hereby corrected as shown below:

Column 9 (line 9), after "which", delete "-".

Column 9 (line 32), delete "are" and insert therefor --arc--.

Column 9 (line 35), delete "are" and insert therefor --arc--.

Signed and Sealed this

Twenty-fifth Day of August, 1998

Bruce Lehman

*Attest:*

BRUCE LEHMAN

*Attesting Officer*

*Commissioner of Patents and Trademarks*